US007261285B2

(12) United States Patent
Kienböck et al.

(10) Patent No.: US 7,261,285 B2
(45) Date of Patent: Aug. 28, 2007

(54) INTERNAL INSERTS IN COOLING TOWERS

(75) Inventors: Martin Kienböck, Ratingen (DE); Miroslav Podhorsky, Ratingen (DE)

(73) Assignee: SPX Cooling Technologies GmbH, Ratingen (DE)

( * ) Notice: Subject to any disclaimer, the term of this patent is extended or adjusted under 35 U.S.C. 154(b) by 0 days.

(21) Appl. No.: 10/784,208

(22) Filed: Feb. 24, 2004

(65) Prior Publication Data

US 2004/0178521 A1 Sep. 16, 2004

(30) Foreign Application Priority Data

Feb. 27, 2003 (EP) ..... 03004187

(51) Int. Cl.
*B01F 3/04* (2006.01)

(52) U.S. Cl. ..... 261/112.1; 261/DIG. 11; 261/DIG. 46

(58) Field of Classification Search ..... 261/97, 261/98, 99, 110, 111, 112.1, 112.2, DIG. 11, 261/DIG. 46
See application file for complete search history.

(56) References Cited

U.S. PATENT DOCUMENTS 4,935,232 A 6/1990 McIntosh
6,288,076 B1 * 9/2001 Kostyniak et al. ..... 514/299
6,575,436 B2 * 6/2003 Litz ..... 261/27
6,706,196 B2 * 3/2004 Holland ..... 210/695
6,710,017 B2 * 3/2004 Unhoch et al. ..... 504/150
6,746,567 B2 * 6/2004 Johnston et al. ..... 159/49
6,811,711 B2 * 11/2004 Unhoch et al. ..... 210/755
6,861,002 B2 * 3/2005 Hughes ..... 210/681
2002/0136885 A1 9/2002 Yeager et al.

FOREIGN PATENT DOCUMENTS

EP 0390765 10/1990
JP 2002348448 12/2002

OTHER PUBLICATIONS

Patent Abstracts of Japan, vol. 2003, No. 4, Apr. 2, 2003 & JP 2002 348448 A (Mitsubishi Plastics Ind Ltd), Dec. 4, 2002.

* cited by examiner

*Primary Examiner*—Scott Bushey
(74) *Attorney, Agent, or Firm*—Baker & Hostetler LLP

(57) ABSTRACT

The invention concerns inserts in the moist/wet region of cooling towers, which essentially consist of plastic. An additive that prevents or considerably reduces soiling through the formation and buildup on the inserts during subsequent use is added to the plastic.

10 Claims, 1 Drawing Sheet

INTERNAL INSERTS IN COOLING TOWERS

FIELD OF THE INVENTION

This invention essentially concerns internal inserts made of plastic in the moist/wet region of cooling towers. Cooling towers are used in various industrial areas to cool water. The cooling water, which becomes heated in the cooling of a process, is introduced into the cooling tower and uniformly distributed within the cooling tower through numerous openings of a conduit system, for example with the aid of spray units or nozzles. In doing so the water that is to be cooled trickles from above onto the so-called cooling inserts and slowly trickles across them. Cooling air used to cool the water is supplied in the opposite direction through the cooling tower. Through evaporation and convection the water gives up heat to the air that is passed through the cooling tower. The water cooled in this way collects below the cooling inserts and is withdrawn from the cooling tower via a collector and piping. The cooled water is used for another cooling of the process, with evaporation losses due to cooling in the cooling tower being made up by fresh water. In doing so, the water again becomes heated and is again sent to be cooled in the cooling tower. In this way the amount of cooling water needed for cooling of a process can be minimized.

BACKGROUND OF THE INVENTION

It is of crucial importance for efficient and problem-free operation of the cooling tower for the water to trickle through the interior of the cooling tower as uniformly and slowly as possible so that it can give up as much heat as possible to the cooling air. Soiling or foreign objects prevent uniform distribution and slow trickling of the water through the tower and therefore reduce its efficiency. If there are foreign particles in the cooling water there is the possibility of filtering these particles out. In any case the moist and warm conditions within a cooling tower disadvantageously promote the formation of microorganisms, for example algae and/or fungi. For this reason it is necessary, in order to guarantee problem-free and efficient operation of a cooling tower, to clean the inserts that are situated within the tower, for example the cooling inserts, pipelines and collectors, since the plugging of cross sections through which water trickles or flows by microorganisms growing on the inserts would likewise give rise to reduced cooling efficiency or failure of the cooling tower. Such cleaning operations disadvantageously give rise to high costs and additionally necessitate interruption of cooling tower operation. In the region of the cooling inserts there have been attempts to reduce their soiling by means of various cooling insert designs, for example film packages, trickle lattices, drip gratings or drip boards, or to increase the insensitivity of the cooling inserts to soiling. However, to achieve a cooling effect that is as high as possible and cooling tower operation that is as efficient as possible it is advantageous to conduct the water to be cooled in a finely divided form and as slowly as possible through the cooling inserts and in this way to achieve a long residence time of the water in the cooling air flow. However, the slow trickle rate of the water favors the formation of algae. An increase of the water trickle rate, conversely, reduces the cooling efficiency achieved with the help of a cooling insert. Partial plugging of the cooling insert cross section through which the water and cooling air flow not only reduces the efficiency but, because of the necessary cleaning, gives rise to high costs, additionally the operating costs rise in the case of cooling towers that push the air through with the aid of blowers, since an increased blower efficiency is necessary in order to pump the necessary cooling air flow through the cooling tower. For this reason the degree of soiling should also be kept as low as possible for reasons of energy consumption.

SUMMARY OF THE INVENTION

This invention has the task of making available inserts for the moist/wet region of cooling towers that reduce the above-described disadvantages of the prior art. In particular, soiling of the inserts of the cooling tower due to formation and buildup of microorganisms is supposed to be avoided or considerable reduced with the help of the inserts in accordance with the invention.

For the technical solution of this task inserts that are essentially made of plastic, to which additives that prevent subsequent soiling due to formation and buildup of microorganisms are added in a sufficient amount, are proposed with the invention.

Through the use of the inserts in accordance with the invention in the moist/wet region of cooling towers soiling of these inserts by formation and buildup of microorganisms in the course of operation of the cooling tower is avoided or to a large degree reduced. Cleaning of these inserts is thus advantageously no longer necessary or necessary only seldom. In this way the costs arising in the operation of the cooling are advantageously reduced.

According to one embodiment of the invention the cooling inserts serving to optimize the heat exchange between water and air consist essentially of a plastic material, to which these additives are added. In this way soiling and/or plugging of the flow holes of the cooling inserts is avoided or reduced. In this was it is advantageously possible to reduce soiling even of cooling inserts that, because of their design, enable slow trickling of the water and thus an especially high cooling effect such as cooling inserts of film packages or trickle lattices.

According to another embodiment of the invention the inserts can be plate heat exchangers. Through the prevention or reduction of biological contamination on the surface of heat exchanger elements the heat transfer from the medium to the heat exchanger or from the heat exchanger to the medium is advantageously guaranteed, where losses due to evaporation of the cooling water in the cooling tower are made up with fresh water.

Advantageously, it is possible to avoid or to delay considerably biological soiling on other fittings in the moist/wet region of cooling towers, for example pipes and nozzles for distribution of the water to be cooled or collectors for return of the cooled water to the process. In the same way the side walls of the cooling tower can be advantageously made of inserts in accordance with the invention or lined with such inserts made in accordance with the invention. In this way biological soiling in the entire internal region of the cooling tower is advantageously reduced, through which its efficiency and operational reliability are increased.

According to one embodiment of the invention the plastic used for the inserts is a thermoplastic such as PVC, to which additives that act as biocide are added. By introducing the additives into the plastic material before processing it to the relevant insets the additives become uniformly distributed over all regions of the relevant insert and in this way prevent biological soiling of the inserts even in places and in regions that are difficult to reach or even no longer accessible because of the position of the inserts in the cooling tower.

These additives especially advantageously contain noble metals and/or noble metal compounds, for example titanium oxides and silver. These additives prevent mold and algae growth, are simple to introduce into the base material of the inserts and are only very weakly toxic.

Figure 1:
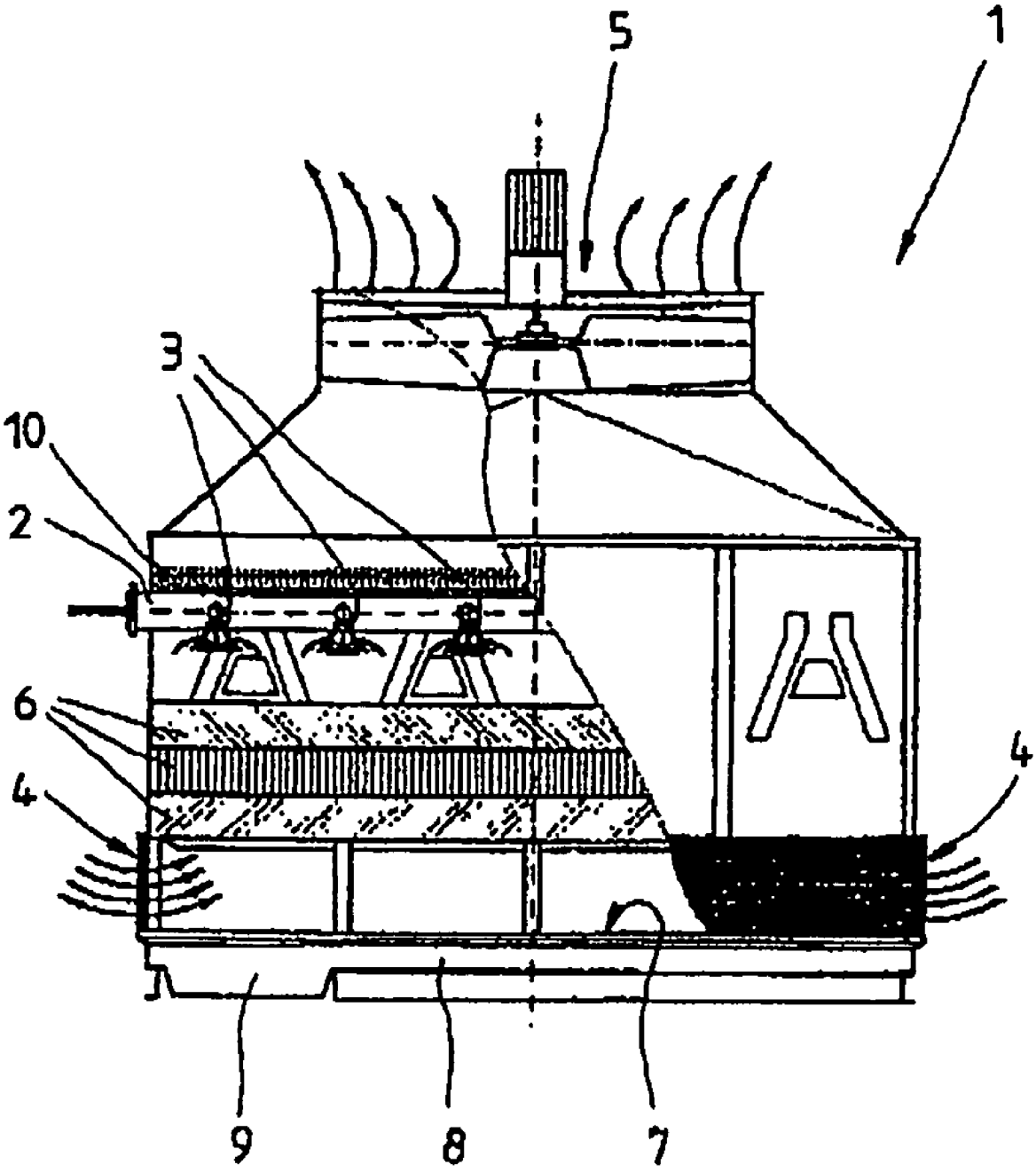
FIG. 1 illustrates a side, sectional view of a cooling tower in accordance with an embodiment of the present invention.

Other advantages and characteristics of the invention result from the following description by means of the figure. The described embodiment serves only for explanation and is not limiting.

DETAILED DESCRIPTION OF THE INVENTION

A counterflow cooling tower 1 is shown in the figure. The water, which is heated to temperatures of about 35° C.-40° C. in the cooling of a process is fed by pipes 2 into cooling tower 1 and uniformly distributed within cooling tower 1 via numerous nozzles 3. The air needed to cool the water gets into the internal space of cooling tower 1 via air inlet holes 4 and is forced through cooling tower 1 in the opposite direction to the trickling of the water with the help of a blower 5.

The water that is sprayed with the help of nozzles 3 "rains" onto cooling inserts 6. The cooling inserts 6 consist of trickle lattices or trickle blocks made of plastic that are bonded to each other. The trickle lattices/blocks form a narrow-mesh, three-dimensional network, which has the purpose of causing the water droplets to trickle downward in the lattice structure of the cooling inserts 6 as slowly as possible.

The cooling inserts 6 are swept by air flowing in the opposite direction. The water droplets that adhere to the lattice structure of the cooling inserts 6 and run down them in beads are thereby swept over by the air. Through convection and evaporation the water gives up heat to the air in this case. The farther the water trickles downward in the cooling insert 6, the more it will be cooled. After trickling through the cooling inserts 6 the water drips onto the bottom region 7 of the cooling tower, flows through return channels 8 to collector 9 and from there is sent to the process that is to be cooled, with losses due to evaporation of the cooling water in the cooling tower being compensated by means of fresh water. To minimize the evaporation loss of the cooling water, demisters 10 are placed above the nozzles 3 and pipes 2. These demisters 10 keep water droplets entrained by the air stream from being carried out.

The fittings of the cooling tower 1, for example the pipes 2, nozzles 3, cooling inserts 6, return channels 8 and collectors 9 here advantageously consist essentially of plastic, to which an additive that acts as biocide is admixed in order to avoid or considerably delay biological soiling. This additive contains insoluble titanium dioxide particles and is capable of releasing silver ions, which act as biocide. In this way the formation and buildup of algae, molds or fungi on the surface of the inserts are avoided or considerable reduce. In accordance with the invention the side walls of the cooling tower can also be proved with the corresponding surfaces or can be provided with additives of the said kind in the surfaces.

The invention claimed is:

1. A cooling tower for cooling fluids, comprising:

sidewalls each essentially formed of a first material which contains only plastic, and a biocide additive mixed into the plastic;

a series of pipes extending from said sidewalls, wherein said series of pipes is essentially formed of a second material which contains only plastic and a biocide additive mixed into the plastic;

a plurality of nozzles connected to said series of pipes, wherein said plurality of nozzles is essentially formed of a third material which contains only plastic and a biocide additive mixed into the plastic; and a moist/wet region comprising cooling inserts, wherein said cooling inserts are essentially formed of a fourth material which contains only plastic and a biocide additive mixed into the plastic.

2. The cooling tower according to claim 1, wherein said inserts serve to optimize heat exchange between air and water through distribution and trickling of water.

3. The cooling tower according to claim 2, wherein said inserts are packages of plastic films arranged side by side.

4. The cooling tower according to claim 2, wherein said inserts are formed of trickle lattices or blocks.

5. The cooling tower according to claim 1, wherein the plastic material is a thermoplastic.

6. The cooling tower according to claim 5, wherein the plastic material is PVC.

7. The cooling tower according to claim 1, wherein the additives are biocides.

8. The cooling tower according to claim 1, wherein the additives contain noble metals and/or noble metal compounds.

9. The cooling tower according to claim 1, wherein the additives are added to the plastic before its processing.

10. The cooling tower according to claim 1, wherein the first material, the second material, the third material, and the fourth material have substantially the same composition as each other.

* * * * *